United States Patent [19]

Cound

[11] Patent Number: 4,526,097

[45] Date of Patent: Jul. 2, 1985

[54] FEED MECHANISM FOR APPARATUS FOR EVACUATING AND COMPACTING AEROSOL CANS

[75] Inventor: Cary D. Cound, La Puente, Calif.

[73] Assignee: American Home Products Corporation, New York, N.Y.

[21] Appl. No.: 499,959

[22] Filed: Jun. 1, 1983

[51] Int. Cl.[3] ..... B30B 15/30

[52] U.S. Cl. ..... 100/215; 100/902; 221/301

[58] Field of Search ..... 100/902, 215; 221/301

[56] References Cited

U.S. PATENT DOCUMENTS

| | | | |
|---|---|---|---|
| 2,279,093 | 4/1942 | Peters | 221/301 X |
| 4,291,618 | 9/1981 | Heiser | 100/902 X |
| 4,368,829 | 1/1983 | Lotspeich | 221/301 X |

*Primary Examiner*—Billy J. Wilhite

*Attorney, Agent, or Firm*—Arthur E. Wilfond

[57] ABSTRACT

An improved feeding mechanism is provided for apparatus used for evacuating and compacting filled aerosol cans. The feeding mechanism is made up of a support plate adapted to be fitted into an inclined feed chute of a compaction and evacuation apparatus. Connected to the support plate is a rocker stop which by reciprocating between first and second positions serves to feed one can at a time into the crushing mechanism. By use of a toggle mechanism connected to both the rocker stop and a chamber door and operated by a pneumatic cylinder, the chamber in which the compaction and evacuation of the containers takes place is separated from the feed mechanism. The feeding mechanism and rocker stop are retained by quick-disconnect devices so that an entire feeding mechanism may be quickly substituted to adapt to feeding cans of different sizes.

7 Claims, 4 Drawing Figures

2
3
10
12
14
16
17
18
20
22
23
24
26
28
30
32
34
36
38
40
42
44
46
48
50
52
54
56
58
59
60
61
62
64

FEED MECHANISM FOR APPARATUS FOR EVACUATING AND COMPACTING AEROSOL CANS

This invention relates generally to can crushing devices, more particularly the invention relates to an improved feed mechanism for apparatus for evacuating and compacting aerosol containers.

This application is an improvement on the aerosol can evacuator and compactor described in application Ser. No. 445,340 filed Nov. 29, 1982, now U.S. Pat. No. 4,459,906 by Cary D. Cound and Joseph A. Vivona. The entire contents of that application are incorporated herein by reference.

The disposal of rejected aerosol-filled containers at a filling plant is a problem. Many propellants are explosive and therefore the recovery operation must be carried out in an explosion-proof area. Explosion-proof apparatus or apparatus for use in explosive areas is much more expensive than apparatus for use where an explosion hazard is not present. Moreover, the contents of the rejected containers are frequently sufficiently valuable to be recoverable at a profit. Also, it may be desirable for the aerosol propellant to be separated from the contents and recovered.

The emptying of rejected aerosol containers has generally been a labor-intensive operation where a great deal of manual effort is required. There is an element of hazard to the operators. In co-pending application Ser. No. 445,340, now U.S. Pat. No. 4,459,906, there is described an air-operated apparatus which by avoiding electricity is suitable for operation in an explosive area. The evacuation and compaction apparatus of that application utilizes an air logic system to control the sequence of the various operational steps. The apparatus includes an air sensor which is adapted to determine that a can is in the proper position for processing. Once in the proper position the can's bottom edge will interrupt the air feed sensor thus transmitting an air signal to the logic system to initiate the feed mechanism, evacuation, crushing and discharge steps.

It is an object of the present invention to provide an improved feed mechanism for apparatus such as is described in the application Ser. No. 445,340.

It is a further object of the present invention to provide a feeding mechanism which is quickly adaptable to handle cans of widely varying sizes.

It is another object of the present invention to improve the protection of the operator from the hazards of gas explosion or combustion.

Other and further objects of the invention will be apparent to those skilled in the art from reading the following description in conjunction with the drawings in which.

Figures 1, 4:
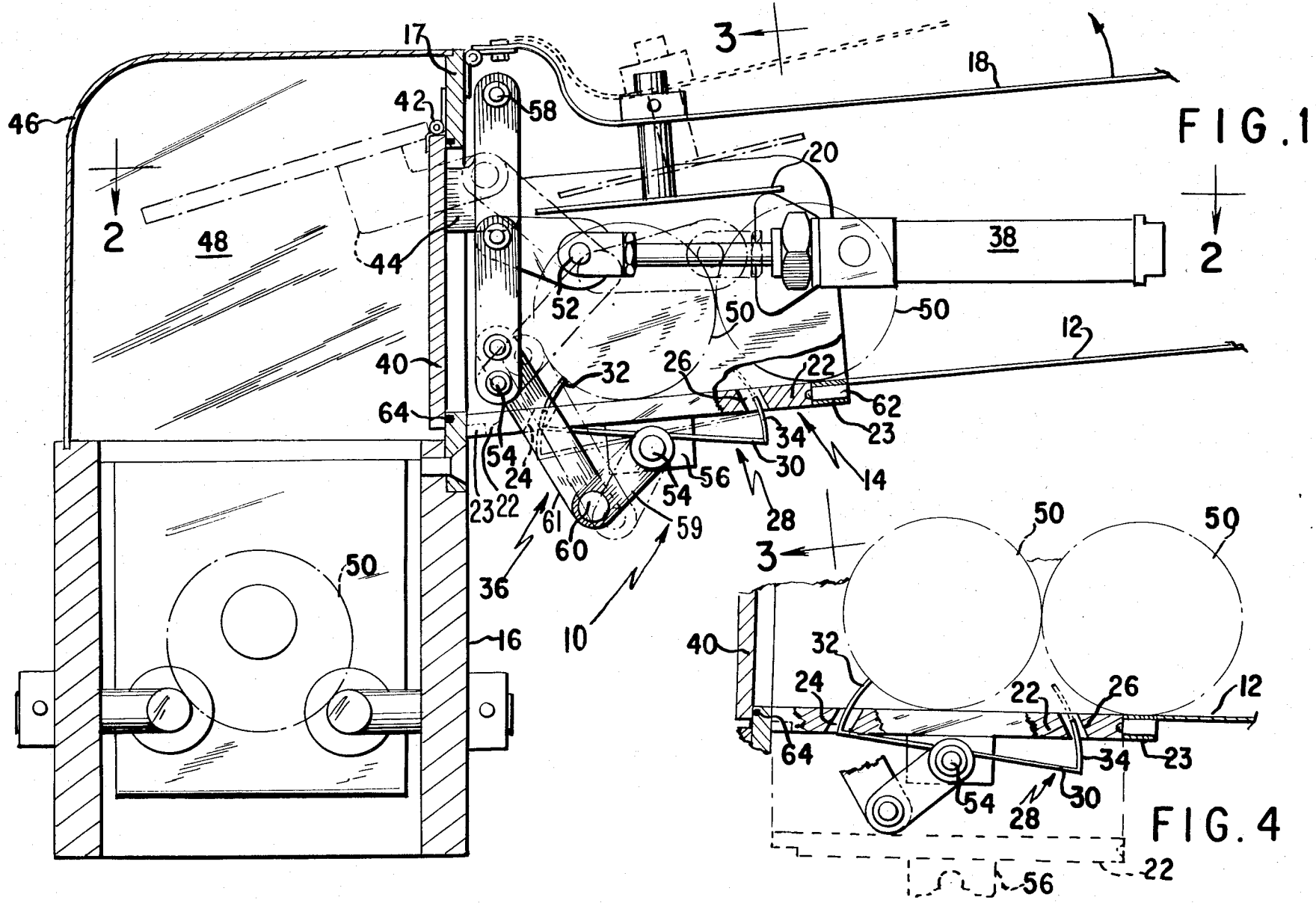
FIG. 1 is a side elevational view, partly in section, of the improved feed mechanism of the present invention showing its position in an inclined feed chute leading to the compression chamber of apparatus for evacuating and compacting aerosol cans.
Figure 2:
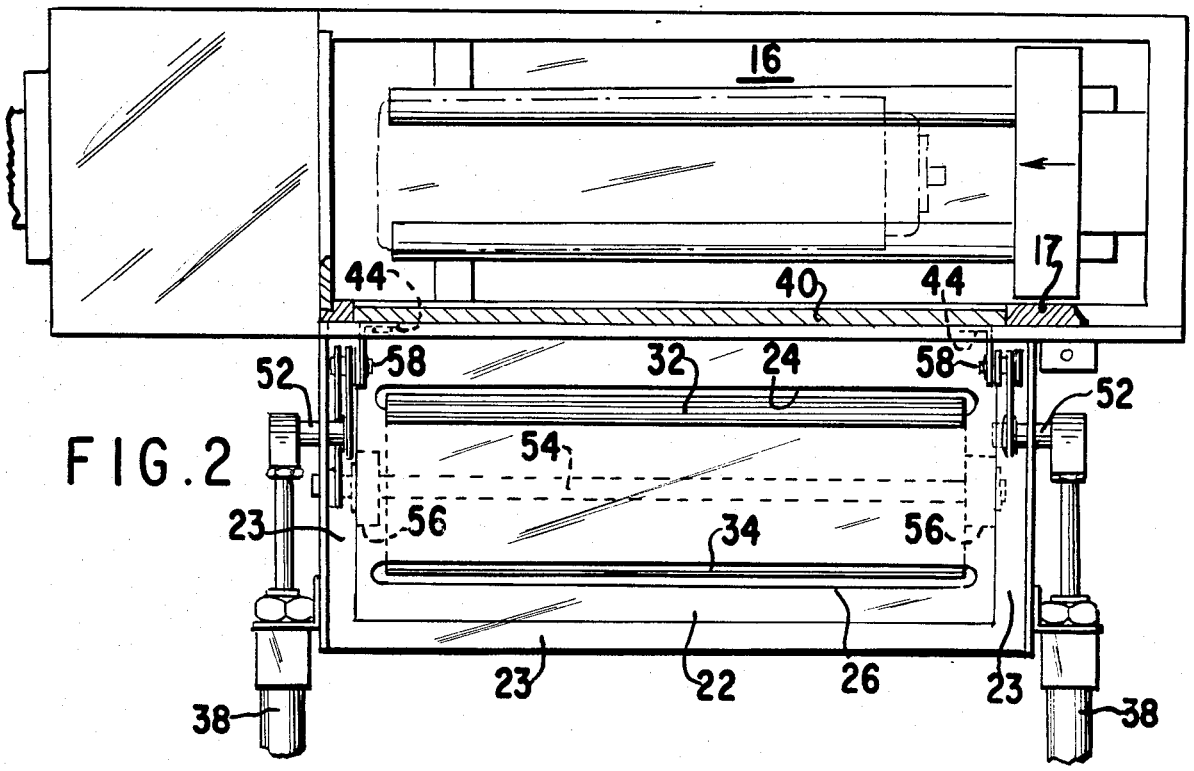
FIG. 2 is a top view, partly in section, taken generally along lines 2—2 of FIG. 1.
Figure 3:
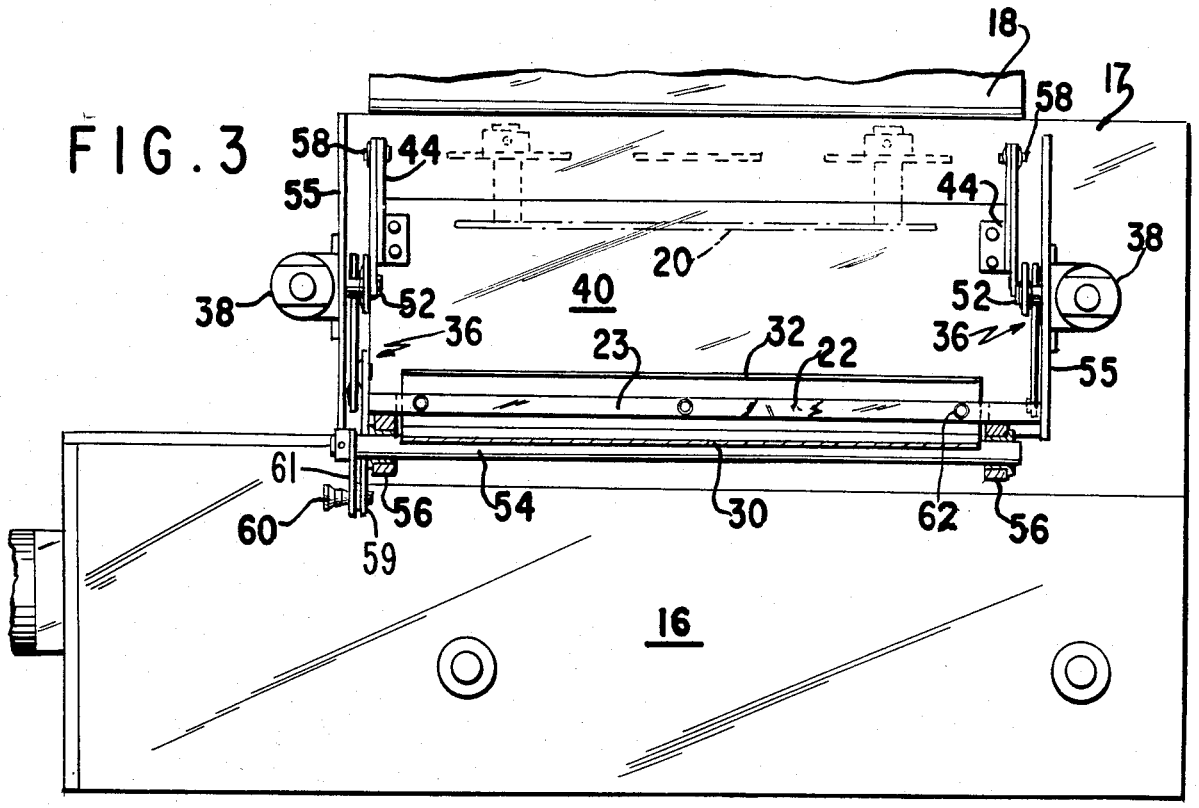

FIG. 3 is a front elevational view, partly in section, taken generally along lines 3—3 of FIG. 1; and FIG. 4 is a detail view, partly in section, showing the operation of the rocker stop The objects of this invention may be achieved in an apparatus for evacuating and compacting aerosol cans which is made up of a feed chute and means connected to the feed chute to sense the orientation of the can and to feed properly oriented cans. The improved feed mechanism, for controlling the gravity feed of the cylindrical articles, is made up of a support plate and a rocker stop movably connected to the support plate and means to rotate the rocker stop between a first position in which an aerosol can is restrained from entering a compression chamber and a second position in which the can is discharged into the compression chamber and a second can is restrained from entering the discharge position. The apparatus also includes a crushing mechanism into which the feed mechanism discharges, a hydraulic ram connected to the crushing mechanism and adapted to move a can to a first position where the can is evacuated and to a second position where the can is compacted. The apparatus further includes a puncturing means reciprocably connected to the crushing mechanism whereby in a first position a can maybe loaded or removed and in a second position the can is punctured. The apparatus further includes air logic means connected to the feed chute, the sensing means, the hydraulic ram and the puncturing means to control the sequence of operation. The crushed cans upon completion of the operation are discharged into a container, and the evacuated gas may, if desired, be recovered or discharged to the atmosphere. Any liquid component, such as an active ingredient insecticide, may be recovered separately, if desired.

As may be seen in FIG. 1, the apparatus 10 for evacuating and compacting aerosol cans is made up of an inclined feed chute 12, a feeding mechanism 14 and a crushing chamber 16. The crushing chamber 16 and other related equipment that form part of the apparatus 10 are described in Application Ser. No. 445,340. The feed chute is connected to a vertical plate 17 and may further have a hinged cover 18 which in the preferred embodiment has a suppression plate 20 connected to it.

The feed mechanism 14 is further comprised of a bottom support plate 22 which is removably connected to a bottom plate 23 of the feed chute and which has openings 24, 26 defined in it. A rocker stop 28 is connected to the support plate 22 and is itself further made up of a base plate 30 which has connected to it a first member 32 and a second member 34. In one position of the rocker stop 28, the first member 32 extends through the opening 24 while the second member 34 is below the surface of the support plate 22. In a second position of the rocker stop 28 the first member 32 is moved below the top of the support plate 22 and the second member 34 extends through the opening 26 above the support plate 22. The rocker stop 28 is operated by a toggle mechanism 36 connected at one end to a pneumatic cylinder 38. A door 40 is connected by a hinge 42 to the vertical plate 17 at the top of the feed chute 12 and is also connected to the toggle mechanism 36 by a bracket 44. A gas-tight housing 46 surrounds the end of the feed chute 12 and the door 40 defining a chamber 48.

Upon the manual insertion of an aerosol can 50, which is cylindrical in shape, into the empty inclined feed chute 12, the can 50 rolls downward by gravity until engaged by the first member 32 of the rocker stop 28. The suppression plate 20 serves to keep the can from rolling over the top of the rocker stop 28 due to rolling momentum.

Upon positioning of the can 50 against the rocker stop member 32 a feed sequence is initiated by the interruption of an air jet switch, not shown, as described in the co-pending application Ser. No. 445,340. Upon initiation of the air logic means by the interrupted air jet switch the penumatic cylinders 38 retract actuating the toggle mechanism 36 from the center pivot point 52. The bottom pivot point 54 is fixed onto the side plate 55 (FIG. 3) and causes a downward motion of the top pivot point 58 to which the door bracket 44 is connected. As the cylinders 38 retract the door is opened while simultaneously actuating the rocker stop 28. As the rocker stop 28 pivots at point 54 in bearing support 56, the first member 32 of the rocker stop rotates below the surface of the bottom support plate 22 allowing the can 50 to roll forward and through the opened door into the crushing chamber 16. As the first member 32 of the rocker stop 28 is rotating down below the surface of the feed plate, the second member 34 is rotating up through support plate 22 thus separating and retaining the aerosol cans that are following the can 50 being fed.

Upon completion of a predetermined delay interval the pneumatic cylinders 38 are extended thus closing the door 40 and reversing the rotation of the rocker stop 28. The next aerosol can within the chute advances to the first member 32 of the rocker stop 28.

Because of the span between the first member 32 and the second member 34 of the rocker stop 28, a variety of different diameter cans maybe fed consecutively without the need to adjust the feed mechanism 14. When cans of a different diameter than can be accepted by the rocker stop 28, are to be crushed, the entire feed mechanism 14 may be quickly changed to accommodate the different size.

As is shown in FIGS. 1 and 3 a quick disconnect pivot pin 60 joins links 59 and 61.

By removal of the quick disconnect pivot pin 60 (FIG. 3) and applying a downward pushing force to the bottom support plate 22 which simultaneously depresses a spring loaded connector 62, the complete removal of the feed mechanism 14 may be accomplished. Replacement by a feed mechanism with a different span can then be made, and, with the replacement of the pivot pin 60, the changeover is complete.

With the incorporation of the toggle mechanism 36 for the purpose of opening and closing the crushing chamber door 40 two additional advantages are realized. Because of the high upward force created by the toggle mechanism and the inherent locking action when the center pivot of the toggle is depressed past its axial center line, the door is closed and locked against a sealing gasket 64 with a strong force. In the event of a bursting aerosol can or the highly unlikely combustion of the can contents, the vapor, or flame, or explosion gases will be contained within the chamber 48 and the crushing chamber 16, thus protecting the operator from the sprayed material or the force of the explosion.

What is claimed is:

1. In an apparatus for evacuating and compacting aerosol cans, the improved feed mechanism connected to a feed chute comprising:

A. a bottom plate;

B. a rocker stop assembly including a rocker stop removably connected to said bottom plate;

C. first means connected to said rocker stop assembly to move said rocker stop between a first position and a second position, whereby in said first position a first can in position for discharge is restrained from discharge and in said second position said first can is discharged and a second can is restrained from entering the discharge position, and a suppression plate movably connected to the feed chute and adapted to prevent a can from rolling over said rocker stop.

2. In an apparatus for evacuating and compacting aerosol cans, the improved feed mechanism connected to an inclined feed chute comprising:

A. a bottom plate;

B. a rocker stop assembly including a rocker stop removably connected to said bottom plate; and C. first means connected to said rocker stop assembly to move said rocker stop between a first position and a second position, whereby in said first position a first can in position for discharge is restrained from discharge and in said second position said first can is discharged and a second can is restrained from entering the discharge position;

D. a chamber located at the discharge end of said feed chute further comprising:

(I) a vertical plate;

(II) a door movably connected to said vertical plate; and (III) a housing;

E. second means connected to said door adapted to close said door when said rocker stop is in said first position and to open said door when said rocker stop is in said second position, and F. a suppression plate movably connected to the feed chute and adapted to prevent a can from rolling over said rocker stop assembly.

3. A feed mechanism for controlling the gravity feed of cylindrical articles in an inclined feed chute comprising:

A. a bottom plate; and

B. a rocker stop assembly removably connected to said bottom plate further comprising:

(I) a second support plate having first and second openings defined therein;

(II) a rocker stop further comprising a base plate and first and second members connected to said base plate; and (III) means connected to said base plate adapted to reciprocate said base plate between first and second positions whereby in said first position said first member projects through said first opening in said second support plate and in said position said second member projects through said second opening in said second support plate, and C. a suppression plate movably connected to the feed chute and adapted to prevent a can from rolling over said rocker stop assembly.

4. The feed mechanism as defined in claim 3 further comprising means to facilitate connection and disconnection of said rocker stop assembly to and from said bottom plate.

5. The feed mechanism as defined in claim 3 further comprising:

D. a chamber located at a lower end of said bottom plate further comprising:

(I) a vertical plate;

(II) a door movably connected to said vertical plate; and (III) a housing; and

E. second means connected to said door adapted to close said door when rocker stop is in said first position and to open said door when said rocker stop is in said second position.

6. The feed mechanism as defined in claim 5 in which a single operating means is operatively connected both to said rocker stop reciprocating means and to said door operating means.

7. The feed mechanism as defined in claim 5 wherein said chamber is explosion-proof.

* * * * *